United States Patent [19]

Shatto

[11] 4,271,745

[45] Jun. 9, 1981

[54] PERCUSSION INSTRUMENTS

[76] Inventor: Homer M. Shatto, 680 Rte. 322 E., East Orwell, Ohio 44034

[21] Appl. No.: 933,865

[22] Filed: Aug. 15, 1978

[51] Int. Cl.[3] ..... G10D 13/02

[52] U.S. Cl. ..... 84/402; 84/411 R

[58] Field of Search ..... 84/402, 403, 404, 411, 84/421, 422 R, 422 S

[56] References Cited

U.S. PATENT DOCUMENTS

| | | | |
|---|---|---|---|
| 863,998 | 8/1907 | Johnson | 84/422 |
| 1,484,777 | 2/1924 | Hassenpflug | 84/422 S |
| 1,986,682 | 1/1935 | Schulz | 84/422 S |
| 2,524,518 | 10/1950 | D'Arcy | 84/411 |
| 2,572,504 | 10/1951 | Meriwether | 84/411 R |
| 3,215,020 | 11/1965 | Kester | 84/411 R |
| 3,368,442 | 2/1968 | Wilcoxon | 84/411 |
| 3,433,115 | 3/1969 | Kjelstrom | 84/411 R |
| 3,509,264 | 4/1970 | Green | 84/411 R |
| 3,791,249 | 2/1974 | Frigo et al. | 84/411 R |
| 4,048,895 | 9/1977 | May | 84/411 R |

OTHER PUBLICATIONS

Ludwig Catalog Number 64, p. 33, Dec. 14, 1964.

*Primary Examiner*—L. T. Hix
*Assistant Examiner*—Alan Mathews
*Attorney, Agent, or Firm*—Michael Williams

[57] ABSTRACT

A novel percussion instrument that may be adjusted to selectively provide well-known cymbal tones and snare drum tones, as well as many other tones which may be a combination or variation of cymbal and snare drum tones. The instrument comprises a tubular casing of rigid material, such as thin metal or plastic, having one end supported on a base and its opposite end open. A thin metal diaphragm overlies the open end of the casing with its peripheral portion in overhanging relation. Means are provided to support the diaphragm intermediate its peripheral portion, and further means are provided to hold the diaphragm against the rim of the casing to provide snare drum tones, or to hold the diaphragm spaced from the rim casing to provide cymbal tones.

17 Claims, 8 Drawing Figures

PERCUSSION INSTRUMENTS

BACKGROUND AND SUMMARY

In all drum constructions known to me, a hide or plastic sheet is stretched over and around the open end of a cylindrical shell. In later years, the hide or plastic sheet was stretched over and around a steel hoop and the latter was clamped over the drum shell rim. In all such constructions, the tone or sound was limited to that of a drum.

In all cymbal constructions known to me, a pair of half globes of thin metal, or a pair of thin metal discs, or singles of each, were center-supported with the pairs of globes or discs movable to striking engagement with each other, or either or singles, were adapted for striking with a drum stick. In all such constructions, the tone or sound was limited to that of a cymbal.

My improved percussion instrument enables a user to produce snare drum tones or sounds with one or two drum sticks and, with a simple adjustment, enables the user to provide cymbal tones or sounds with one or two drum sticks, and in either type of adjustment, additional tones may be produced which are bizzare, unconventional tones as well as previously unheard harmonious tones.

The percussion instrument of my invention is low in cost, as compared to conventional snare drums and cymbals, and comprises a tubular shell or casing having one end supported on a base and an opposite end open. A thin metal diaphragm is center-supported in position above the open end of the shell with its peripheral portion overhanging the rim of such open end. Means are provided to dispose the diaphragm in spaced relation with the shell rim, or in engagement therewith.

DESCRIPTION OF THE DRAWINGS

In the drawings accompanying this specification and forming part of this application, there are shown, for purpose of illustration, several embodiments which my invention may assume, and in these drawings.

DESCRIPTION OF THE PREFERRED EMBODIMENT

Figure 1:
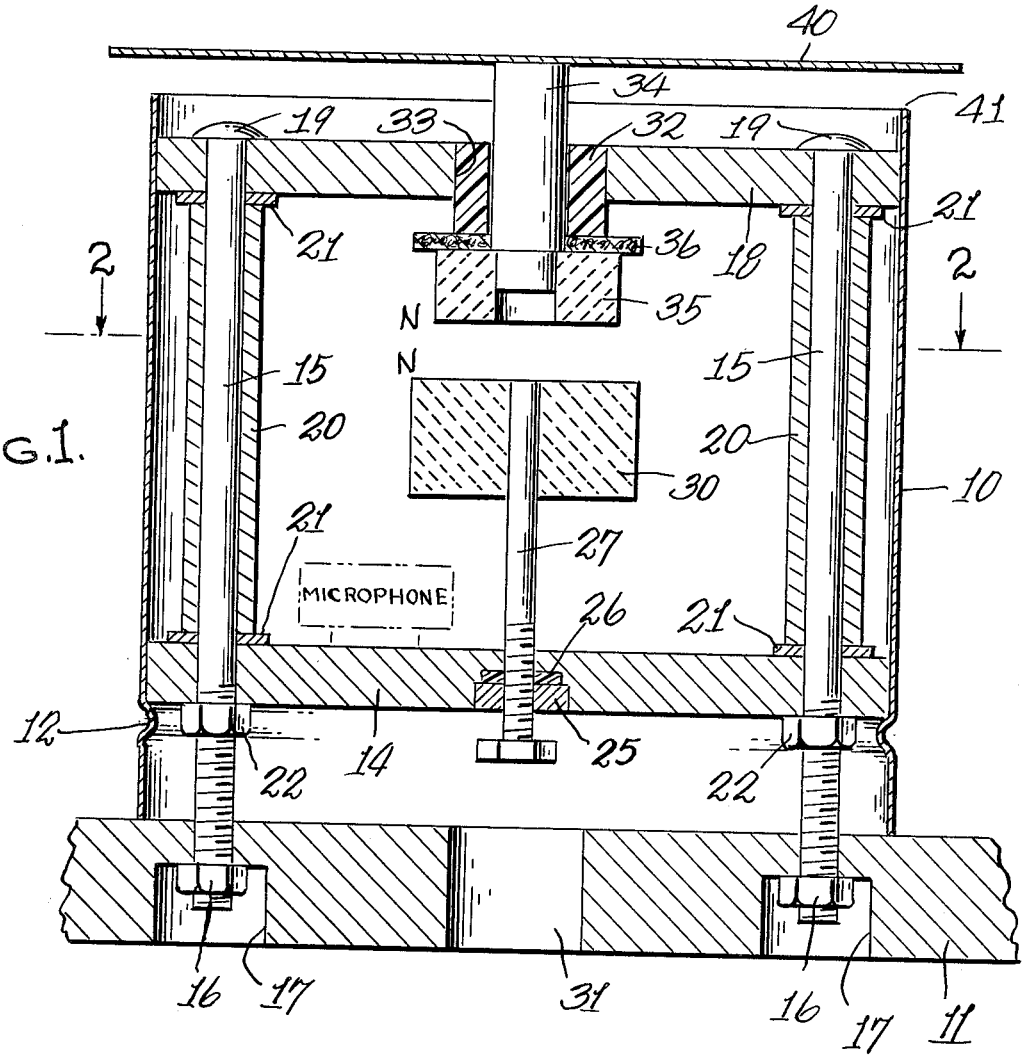
FIG. 1 is a central, vertical sectional view through a percussion instrument showing a presently preferred embodiment of my invention, the drawing being approximately to full scale, and the diaphragm in position for cymbal tones.
Figure 2:
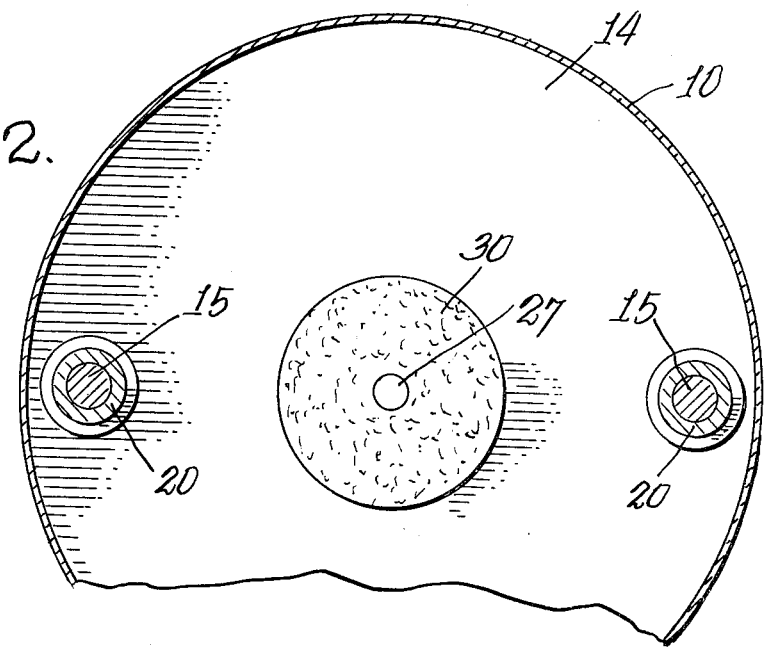
FIG. 2 is a fragmentary, transverse sectional view, corresponding to the line 2—2 of FIG. 1.
Figure 3:
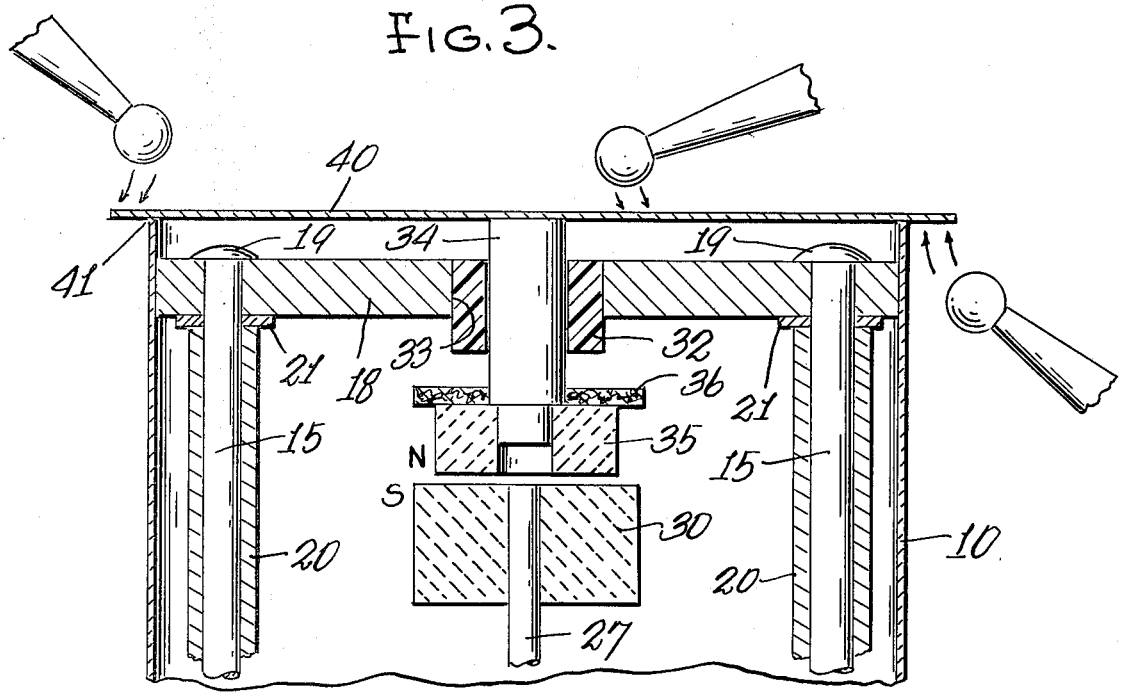
FIG. 3 is a fragmentary view similar to FIG. 1, but showing the diaphragm in position for snare drum tones.

With reference to FIGS. 1 through 3, my preferred embodiment comprises a tubular shell or casing 10 which may be formed of any suitable thin-gauge material, such as steel, plastic or the like. The shell is preferably open at both ends and has its lower end supported on a base 11 which may be made of wood, pressed wook, plastic or the like.

In the embodiment shown, the shell is cylindrical and this shape is preferred for ease of manufacturing and assembly. Spaced upwardly from the lower end of the shell 10 is an inwardly protruding annular rib 12 which, in the case of steel, may be formed in a rolling operation. The rib forms a shoulder against which the lower surface of a disc 14 abuts. The disc may be formed of the same material as the base but, as shown, is not as thick as the latter.

A pair of diametrically opposed upright bolts 15—15 have their lower threaded portions passing through respective holes in the disc 14, the lower ends of the bolts 15 passing through respective holes in the base and receiving nuts 16—16. The holes in the base are counterbored, as shown at 17, so that the nuts and the lower end of the bolts are clear of the lower surface of the base.

A second disc 18, like the disc 14, is disposed within the shell near the upper end thereof. The bolts 15 pass through respective holes in the disc 18 and have heads 19 bearing against the upper surface of the latter. Spacer sleeves 20—20 are disposed around the bolts 15 to space the discs 14 and 18 a predetermined amount. Washers 21 may be disposed between the ends of the sleeves and the adjoining surfaces of the discs 14 and 18 so that nuts 22 may be pulled up tightly without the ends of the sleeves digging into the disc surfaces.

A Nylock nut 25 is press-fitted within a central opening in the lower surface of the disc 14, the nut having a nylon head 26. The nut may further be secured against turning and displacement by epoxy glue. Threaded through the nut, and held against free rotation by the nylon head 26, is a threaded brass rod 27 having a hexagonal adjustment head at its lower end. A permanent magnet 30 is secured to the upper end of the adjustment rod. The magnet is preferably a circular ceramic disc having a central opening in which the upper end of the adjustment rod fits and is secured by epoxy glue. The base 11 has an opening 31 to pass a socket wrench (not shown) for the purpose of longitudinally adjusting the rod 27 and supported magnet 30.

A sleeve bearing 32, preferably of nylon, is press-fitted and epoxy glued into a central opening 33 in the top disc 18. The sleeve bearing 32 receives a short brass rod 34 to guide the latter for longitudinal movement, but with a little play between interengaging surfaces. An upper permanent magnet 35 is also preferably a circular ceramic disc and is formed with a central opening in which the reduced lower portion of the rod fits and is secured by epoxy glue. A felt washer 36 is preferably disposed between facing surfaces of the sleeve and the magnet 35.

Secured to the upper end of rod 34 and extending transversely thereof, is a thin metal diaphragm 40 which is in the form of a circular disc with a diameter larger than the diameter of the upper rim 41 of the shell so as to overhang and extend beyond the same. The diaphragm is formed of a thin extremely hard spring metal, such as beryllium copper alloy, and may be silver soldered, epoxy glued, or otherwise secured to the upper extremity of the rod 34. The diaphragm is thin enough to vibrate freely, but thick enough to take a beating from the drumsticks. The thickness of the diaphragm 40 may vary from about 0.005 to 0.040 inches (0.1269 to 0.9235 millimeters). Various tones are possible by altering the alloy, temper, thickness and diameter of the diaphragm.

In FIG. 1, the magnets 30 and 35 are arranged with opposite poles facing so that the magnets repel each other. Since the lower magnet is stationary, after any adjustment, the upper magnet is repelled upwardly to the position shown in FIG. 1, wherein the diaphragm is spaced upwardly from the rim 41, and may be struck with a drum stick for cymbal tones. Tones may be changed by adjustment of the rod 27 from the maximum thrust of the magnets for full cymbal tone, to a minimum thrust (by lowering the magnet 30) wherein the diaphragm 40 barely touches the rim 41. At this point, only minute variations of thrust create tiny variations of clearance, causing changes in mutations of ringing, hissing, sizzling and rustling tones.

The discs 14 and 18, magnet 30, adjusting rod 27, magnet 35, nylon bearing 32 and diaphragm 40 may be secured together as a sub-assembly, the bolts 15—15 holding the discs 14 and 18 in predetermined spaced relation. The nuts 16 are omitted from this sub-assembly. To assemble the shell 10 with the sub-assembly, the top end of the shell is slid over the disc 14 and then over the disc 18 until the shoulder formed by the inturned rib 12 abuts the underside of the disc 14. The lower end of the bolts 15 are then inserted through respective holes in the base 11 and the nuts 16 are applied to and threaded on the bolt ends to clamp the lower end of the shell against the top surface of the base.

The construction shown in FIG. 3 is similar to that of FIG. 1, with the exception that one of the magnets 30, 35 has been reversed so that the magnets are attracted to each other. Normally, it is preferred to reverse the magnet 30 so that opposite poles of the magnets face each other. Since the magnet 30 is stationary, after any adjustment, the upper magnet 35 is drawn toward the magnet 30 and the construction is such that the diaphragm 40 is seated against the rim 41 of the shell. FIG. 3 shows a slight space between the magnets, and this is preferred to prevent the magnets from striking each other upon extreme downward deflection of the diaphragm which may be caused by a heavy blow thereon.

The diaphragm 40 is now in position to produce snare drum tones when struck by a drum stick. As before, tones may be changed by vertical adjustment of the lower magnet. For example, light, skimming, shimmering tones may be produced by decreasing magnetic pull on the upper magnet to a point where such pull is practically non-existent so that only the weight of the diaphragm holds it against the shell rim. For full choke snare drum tone, the pull is increased between the magnets by upward adjustment of the lower magnet until the desired snare tone is obtained.

As seen in the drawings, the diaphragm 40 is not secured at its peripheral edge; rather it is held at its center by the rod 34 which freely slides through the bearing sleeve 32. In the drum form shown in FIG. 3, any ringing sound inherent in a metal diaphragm is choked, dampened, deadened, muffled and muted into the neutral tone of a drum. A metal diaphragm vibrating against a metal rim gives new sounds; that is metallic sounds much desired for accompaniment to metallic sounds emanating from metallic based instruments, such as brass wind instruments, string and bar vibrating instruments, and electronic oscillatory instruments. To amplify any tone, a pick-up microphone may be disposed within the shell, as suggested in FIG. 1.

Various tonal effects may be obtained by striking the diaphragm with downward or upward blows of a drumstick, at its peripheral surface, or by striking an intermediate portion of the diaphragm, as indicated in FIG. 3. Although the diaphragm is shown as a perfectly flat disc, it may have some concavity or convexity.

Figure 7:
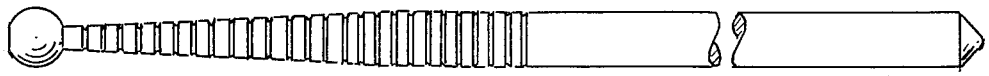
FIG. 7 is an elevational view of a drum stick which is used to produce various unusual sounds with any one of the abovenoted embodiments.

A further desirable tonal effect may be obtained by using one or two drumsticks of the type shown in FIG. 7. The stick therein shown has a plurality of serrations along a large part of its length, such as by forming spaced annular grooves thereon as shown. By drawing the serrated edges across the edge of the diaphragm, vastly increased frequency of diaphragm actuation is attained, as compared with the slower frequency bounce of drumsticks. Instead of the paralled grooves shown, a spiral groove may be formed with a single cutting tool.

DESCRIPTION OF OTHER EMBODIMENTS

Figure 4:
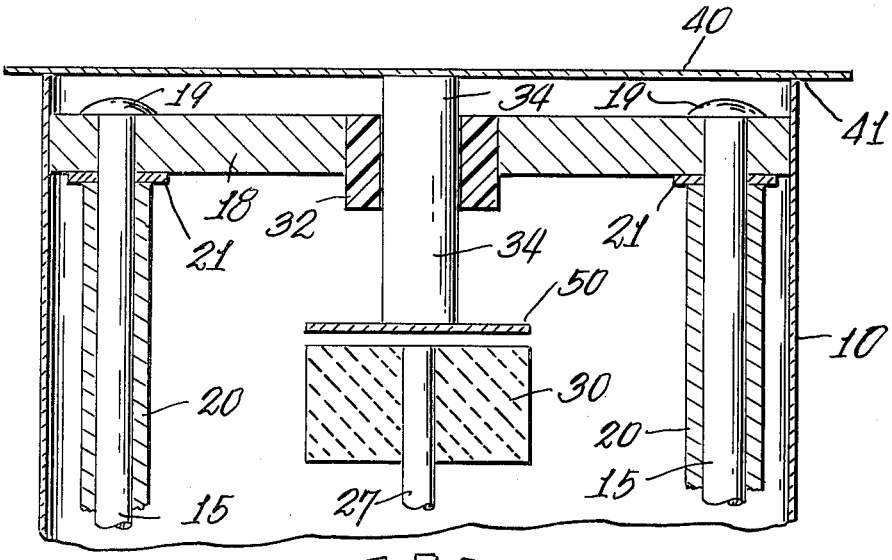
FIG. 4 is a fragmentary sectional view similar to FIG. 3, but showing a slight difference in construction.

The construction shown in FIG. 4 is usable only for snare drum type instruments. The construction is largely the same as heretofore described except that the upper magnet is omitted and a metal disc 50 is connected to the lower end of the rod 34. In this case, the disc 50 is attracted toward the lower magnet 35.

Figure 5:
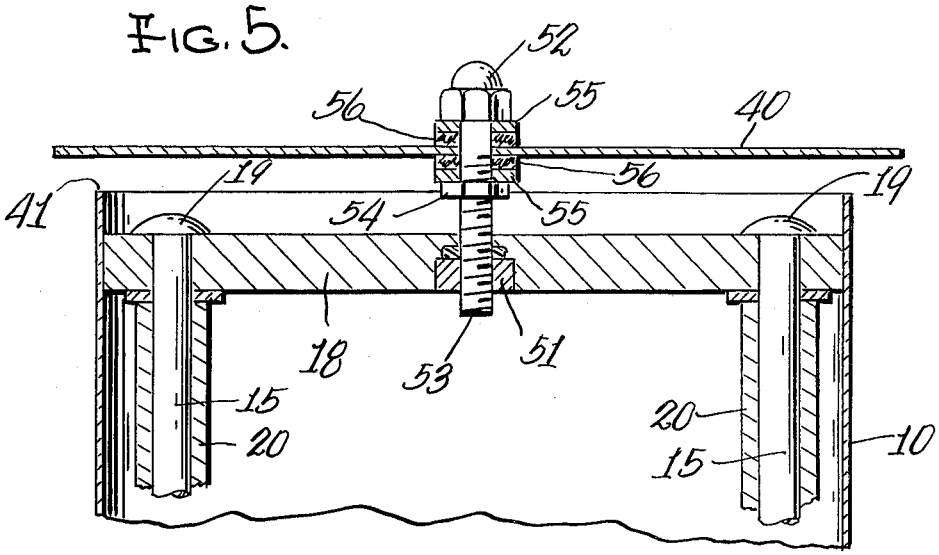
FIG. 5 is a fragmentary view similar to FIG. 1, but showing another embodiment of my invention.

In the construction shown in FIG. 5, both magnets are omitted. A Nylock nut 51 is press-fitted and epoxy glued into a central opening in the upper disc 18. The diaphragm 40 is clamped between the acorn head 52 of a threaded bolt 53 and a nut 54 threaded on the bolt. Washers 55 and felt discs 56 are interposed between opposite sides of the diaphragm and the bolt head 52 and nut 54. By turning the bolt 53 through means of a wrench applied to the head 52, the diaphragm may be spaced a selected distance from the rim, or held thereagainst.

Figure 6:
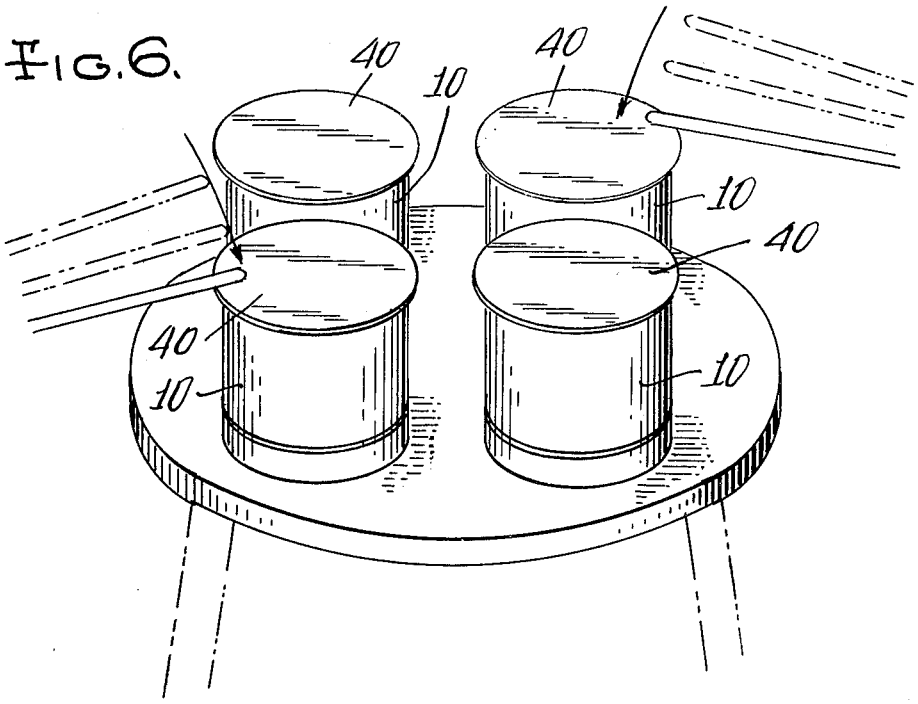
FIG. 6 is a perspective view showing a cluster of percussion instruments of my invention.

FIG. 6 shows a plurality of instruments mounted on a base 11, with two or more preferred. In FIG. 6, four instruments are mounted in a cluster and each may have a diaphragm of a different thickness, alloy, temper or diameter. Dual tones may be produced by striking one diaphragm with one drumstick and a different diaphragm with another stick. Further, to add more zest to playing and even more color to the sound, the player need merely shift the tips of the sticks from one diaphragm to another.

Figure 8:
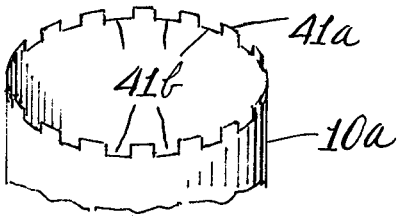
FIg. 8 is a fragmentary, perspective view, drawn to a reduced scale, of a modified form of shell that may be used in the percussion instrument.

FIG. 8 shows a shell **10*a* that may be substituted for the shells heretofore described. The shell 10*a* differs only in that its rim 41*a* is formed with a series of notches 41*b***. These notches provide extra sound escapement from the shell and, since less rim surface contacts the diaphragm, the less the latter will be choked or muffled.

For drum heads requiring minimal choke, the notches could be increased, either in size or number. For drum heads requiring greater choke, the notches could be decreased, either in size or number to a point where practically the entire rim surface will be contacted by the diaphragm. Because of this variable sound effects which may be provided bychanges in the size or number of the notches, the latter may be termed sound notches.

I claim:

1. A percussion instrument, comprising:

a tubular shell formed of rigid, thin-wall material, having a rim defining an open end thereof, a thin metal diaphragm disposed transversely of said open end having a peripheral portion overlying said rim, said diaphragm being adapted for striking by a drumstick or the like, inner and outer discs held within and transversely of said shell in spaced-apart relation axially of the latter, said outer disc having one surface directed toward said shell open end and its other surface directed toward the interior of said shell, and said outer disc having an axially arranged central opening, means supporting said diaphragm from said shell, comprising a first rod slidable axially through said central opening and having one end extending from said outer disc one surface and connected to a central portion of said diaphragm, the opposite end of said rod extending from said outer disc other surface, a first permanent magnet connected to said rod opposite end, said inner disc having one surface directed toward said outer disc other surface, and having an axially-arranged central opening, a second rod extending through said inner disc central opening, and a second permanent magnet secured to an end of said second rod, said first and second magnets having poles in confronting relation.

2. The construction according to claim 1 wherein a nut is held within said inner disc central opening, and wherein said second rod has external screw threads engaging the threads of said nut, whereby rotation of said second rod in one direction or the other will effect movement of said second magnet toward or away from said first magnet.

3. The construction according to claim 2 wherein one pole of said first magnet is in confronting relation with the same pole of said second magnet to effect repulsion of said first magnet.

4. The construction according to claim 2 wherein one pole of said first magnet is in confronting relation with the opposite pole of said second magnet to effect attraction of said first magnet.

5. A percussion instrument, comprising:

a tubular shell formed of rigid, thin-walled material, having a rim defining an open end thereof, a thin metal diaphragm disposed transversely of said open end and having a peripheral portion overlying said rim, said diaphragm being adapted for striking by a drumstick or the like, inner and outer discs held within and transversely of said shell in spaced-apart relation axially of the latter, said outer disc having one surface directed toward said shell open end and its other surface directed toward the interior of said shell, said outer disc having an axially-arranged central opening, means supporting said diaphragm from said shell, comprising a first rod slidable axially through said central opening and having one end extending from said outer disc one surface and connected to a central portion of said diaphragm, the opposite end of said rod extending from said disc other surface, a magnetically-attractable member connected to said rod opposite end, said inner disc having one surface directed toward said outer disc other surface and having an axially-arranged central opening, a second rod extending through said inner disc central opening, and a permanent magnet secured to an end of said second rod and adapted to attract said magnetically-attractable member.

6. A percussion instrument, comprising:

a tubular shell formed of rigid, thin-wall material, having a rim defining an open end thereof, a thin metal diaphragm disposed transversely of said open end and having a peripheral portion overlying said rim, said diaphragm being adapted for striking by a drumstick or the like, a disc held within and transversely of said shell and having one surface directed toward said shell open end, said disc having an axially-arranged central opening, a nut fixed within said central opening, a threaded rod working through said nut and having an end connected to said diaphragm at a central portion thereof, threading of said nut in one direction or the other effecting movement of said diaphragm toward and away from said rim.

7. A percussion instrument, comprising, a tubular shell having a rim defining an open end thereof, a diaphragm of thin, rigid but yet resilient material, said diaphragm being disposed transversely of said shell open end and having its peripheral portion overlying said rim and having a transverse dimension at least equal to the transverse dimension of said rim, and supporting means within the confines of said rim and connected to said diaphragm at a portion intermediate said peripheral portion, and supporting said diaphragm from said shell with its peripheral portion overlying and transversely coextensive with said rim, and free to vibrate when struck by a drumstick and the like.

8. The construction according to claim 7 wherein said supporting means has a fixed, rigid connection with said diaphragm intermediate portion so that the latter is held against vibration and said diaphragm is firmly held relative to said shell.

9. The construction according to claim 7 wherein the transverse dimension of said diaphragm is larger than the transverse dimension of said rim to thereby extend beyond the latter.

10. The construction according to claim 8 wherein said diaphragm is supported in closely spaced relation with respect to said rim whereby its peripheral portion is free to strike against said rim when struck hard enough.

11. The construction according to claim 7 wherein said rim has a plurality of notches spaced apart peripherally thereof.

12. A percussion instrument, comprising, a rigid, cylindrical shell having a rim defining an open end thereof, said rim being disposed in a plane substantially normal to the longitudinal axis of said shell, a generally flat diaphragm, circular in shape and made of springy metal, and supporting means carried by said shell and extending along the latter's longitudinal axis and having a portion connected to the central portion of said diaphragm to hold the latter concentric with said rim and with its peripheral portion overlying and generally parallel to the plane in which said rim is disposed, said supporting means portion constituting the only connection with said diaphragm so that said diaphragm peripheral portion may vibrate when struck by a drumstick and the like.

13. The construction according to claim 12 wherein said shell has a disc in fixed position cross-wise thereof, said disc having a central opening, and said support means portion comprising a rod having an outer end fixed to the central portion of said diaphragm and an inner end fitting within said central opening.

14. The construction according to claim 13 wherein said rod has sliding fit with said central opening.

15. The construction according to claim 13 wherein said rod is threaded into said central opening.

16. The construction according to claim 14 wherein said rod is urged in a direction to space said diaphragm from said rim.

17. A percussion instrument, comprising, a tubular shell having a rim defining an open end thereof, a diaphragm of thin, rigid but yet resilient material, said diaphragm being disposed transversely of said shell open end and having its peripheral portion overlying said rim and having a transverse dimension at least equal to the transverse dimension of said rim, and supporting means within the confines of said rim and connected to said diaphragm at a portion intermediate said peripheral portion, and supporting said diaphragm from said shell with its peripheral portion overlying and transversely coextensive with said rim, said supporting means being adjustable so that said diaphragm may be selectively held in spaced relation with said rim, or in abutment with said rim.

* * * * *